US011421844B2

(12) United States Patent
Zhang et al.

(10) Patent No.: US 11,421,844 B2
(45) Date of Patent: Aug. 23, 2022

(54) OPTICAL MODULE AND AUTOMOBILE LAMP

(71) Applicant: HASCO VISION TECHNOLOGY CO., LTD., Shanghai (CN)

(72) Inventors: Dapan Zhang, Shanghai (CN); Zhiping Qiu, Shanghai (CN)

(73) Assignee: HASCO VISION TECHNOLOGY CO., LTD., Shanghai (CN)

( * ) Notice: Subject to any disclaimer, the term of this patent is extended or adjusted under 35 U.S.C. 154(b) by 155 days.

(21) Appl. No.: 16/493,343

(22) PCT Filed: Mar. 29, 2019

(86) PCT No.: PCT/CN2019/080580
§ 371 (c)(1),
(2) Date: Sep. 12, 2019

(87) PCT Pub. No.: WO2019/196687
PCT Pub. Date: Oct. 17, 2019

(65) Prior Publication Data

US 2021/0231278 A1 Jul. 29, 2021

(30) Foreign Application Priority Data

Apr. 13, 2018 (CN) ..... 201810331756.2

(51) Int. Cl.
*F21S 41/25* (2018.01)
*F21S 41/24* (2018.01)
(Continued)

(52) U.S. Cl.
CPC ..... *F21S 41/25* (2018.01); *F21S 41/24* (2018.01); *F21S 41/29* (2018.01); *F21S 41/32* (2018.01);
(Continued)

(58) Field of Classification Search
None
See application file for complete search history.

(56) References Cited

U.S. PATENT DOCUMENTS 9,046,237 B2 * 6/2015 Stefanov ..... F21S 41/143
10,876,696 B2 * 12/2020 Plank ..... F21S 41/141
(Continued)

FOREIGN PATENT DOCUMENTS

CN 105570794 A 5/2016
CN 205991417 U 3/2017
(Continued)

OTHER PUBLICATIONS

Decision to Grant issued in corresponding KR10-2019-7023674, dated Apr. 14, 2021. Partial English translation provided.
(Continued)

*Primary Examiner* — Elmito Breval
(74) *Attorney, Agent, or Firm* — Wolter Van Dyke Davis, PLLC; Eugene J. Molinelli

(57) ABSTRACT

An optical module and an automobile lamp are provided, relating to a technical field of automobile lamps. The optical module comprises a light-condensing assembly and a plurality of high beam light sources, the plurality of high beam light sources are provided at intervals in one direction, the light-condensing assembly comprises a condenser, the condenser comprises a plurality of light guiding members, a light incident end of each of the light guiding members is provided in one-to-one correspondence with each of the high beam light sources, and light emergent ends of each of the light guiding members converge together and form an arc-shaped light emergent portion, and an included angle between adjacent light guiding members is an acute angle.

13 Claims, 4 Drawing Sheets

(51) Int. Cl.

| | |
|---|---|
| ***F21S 45/43*** | (2018.01) |
| ***F21S 41/29*** | (2018.01) |
| ***F21S 45/47*** | (2018.01) |
| ***F21S 41/32*** | (2018.01) |
| *F21W 107/10* | (2018.01) |

(52) U.S. Cl.
CPC ..... *F21S 45/43* (2018.01); *F21S 45/47* (2018.01); *F21W 2107/10* (2018.01)

(56) References Cited

U.S. PATENT DOCUMENTS

| | | | | |
|---|---|---|---|---|
| 2009/0073710 | A1* | 3/2009 | Sormani | F21S 41/143 362/509 |
| 2010/0046242 | A1* | 2/2010 | Lambert | B60Q 1/0041 362/509 |
| 2012/0275173 | A1 | 11/2012 | Hamm et al. | |
| 2014/0133168 | A1* | 5/2014 | Fiederling | F21S 41/153 362/511 |
| 2014/0169014 | A1* | 6/2014 | Jungwirth | F21S 41/151 362/509 |
| 2014/0198513 | A1* | 7/2014 | Stefanov | F21S 41/663 362/511 |
| 2014/0204602 | A1* | 7/2014 | Jungwirth | F21S 41/43 362/521 |
| 2014/0307459 | A1* | 10/2014 | Brendle | F21S 41/151 362/520 |
| 2015/0226395 | A1* | 8/2015 | Taudt | F21S 41/153 362/511 |
| 2016/0265732 | A1* | 9/2016 | Jacquemin | F21S 43/237 |
| 2016/0290583 | A1* | 10/2016 | Suwa | F21S 41/43 |
| 2016/0334072 | A1* | 11/2016 | Meyrenaud | F21S 41/26 |
| 2016/0377254 | A1* | 12/2016 | Thiel | F21S 43/315 362/511 |
| 2017/0114976 | A1* | 4/2017 | Beev | F21S 41/24 |
| 2017/0167680 | A1* | 6/2017 | Mitchell | B60Q 3/64 |
| 2019/0017675 | A1* | 1/2019 | Suwa | F21S 41/147 |

FOREIGN PATENT DOCUMENTS

| | | | |
|---|---|---|---|
| CN | 206268977 | U | 6/2017 |
| CN | 206592963 | U | 10/2017 |
| CN | 108397743 | A | 8/2018 |
| CN | 207962511 | U | 10/2018 |
| EP | 2 518 397 | A2 | 2/2012 |
| JP | 2016-39020 | A | 3/2016 |
| JP | 2016-184578 | A | 10/2016 |
| JP | 2017-199660 | A | 11/2017 |
| JP | 2017-212037 | A | 11/2017 |
| WO | 2017/157706 | A1 | 9/2017 |
| WO | 2017/198505 | A1 | 11/2017 |

OTHER PUBLICATIONS

International Search Report issued in corresponding PCT/CN2019/080580, dated Jul. 5, 2019.

Written Opinion of the International Searching Authority issued in corresponding PCT/CN2019/080580, dated Jul. 5, 2019.

Japanese Office Action issued in corresponding JP2019-531371, dated Mar. 30, 2021. English translation provided.

Korean Office Action issued in corresponding KR10-2019-7023674, dated Oct. 17, 2020. English translation provided.

Decision to Grant a Patent with translation in corresponding JP Patent App No. 2019-531371 dated Sep. 14, 2021, pp. 1-4.

* cited by examiner

OPTICAL MODULE AND AUTOMOBILE LAMP

CROSS-REFERENCE TO RELATED APPLICATION

This application is a 371 national stage application of PCT Application No. PCT/CN2019/080580, filed Mar. 29, 2019, and claims the priority to a Chinese patent application No. CN2018103317562 filed with the Chinese Patent Office on Apr. 13, 2018 and entitled "Optical Module and Automobile Lamp", the content of which is incorporated entirety herein by reference.

TECHNICAL FIELD

The present disclosure relates to the technical field of automobile lamps, and in particular to an optical module and an automobile lamp.

BACKGROUND ART

An automobile lamp is one of the important parts of an automobile, and can provide illumination for the automobile as driving under dim light conditions, for example, poor light conditions, haze weather or rainy weather, etc. With high brightness and excellent energy saving property, LED light sources are increasingly applied to the automobile lamp.

A driver often turns on the high beam lamp of the automobile when driving in a dark environment at night, so that the driver can have a view within a wider range, which thus facilitates to know the road condition ahead better.

However, for a vehicle travelling opposite to the vehicle whose high beam lamp is turned on, the driver will be dazzled as illuminated by the high bright, intense light of the high beam lamp, such that the driver cannot see clearly the road condition, which will likely cause traffic accidents.

SUMMARY

An object of the present disclosure is to, for example, provide an optical module to solve the technical problem existing in the prior art that the driver of the vehicle travelling opposite will be dazzled due to the intense light emitted by the high beam lamp.

Embodiments of the present disclosure may be implemented as follows:

The embodiment of the present disclosure provides an optical module, comprising: a light-condensing assembly and a plurality of high beam light sources, wherein the plurality of high beam light sources are provided at intervals in one direction, the light-condensing assembly comprises a condenser, the condenser comprises a plurality of light guiding members, a light incident end of each of the light guiding members is provided in one-to-one correspondence with each of the high beam light sources, and light emergent ends of each of the light guiding members converge together, and form an arc-shaped light emergent portion, and an included angle between adjacent light guiding members is an acute angle.

Optionally, an end face of the light incident end of the light guiding member is arc-shaped.

Optionally, the end face of the light incident end is provided with a light-condensing groove having a center point corresponding to a center point of the high beam light source.

Optionally, the light guiding member has a width increasing gradually from a side of the light guiding member where the light incident end is located to a side of the light guiding member where the light emergent end is located.

Optionally, the optical module further comprises a high beam circuit board, and the high beam light sources are mounted on the high beam circuit board.

Optionally, the optical module further comprises a heat sink, the high beam circuit board is mounted on the heat sink, the light-condensing assembly further comprises a mounting bracket, and the condenser is connected with the heat sink through the mounting bracket.

Optionally, the heat sink is provided with a positioning post, and the mounting bracket is provided with a positioning groove that cooperates with the positioning post.

Optionally, the mounting bracket comprises a first connecting member and a second connecting member both connected with the condenser, the first connecting member is provided thereon with a plurality of position limiting grooves, the light incident end of the light guiding member of the condenser protrudes beyond the position limiting groove, and the first connecting member and the second connecting member are respectively located at the two opposite sides of the condenser.

Optionally, the first connecting member is provided with a position limiting post, and the second connecting member is provided with a position limiting hole that cooperates with the position limiting post.

Optionally, a bottom of the light emergent portion of the condenser is provided with a collar, and a top of the first connecting member is provided with a receiving groove for receiving the collar.

Optionally, the second connecting member comprises a pressing plate and an extension portion(s) that are connected to each other, the pressing plate is in contact with an area of the condenser close to the light incident end, and a side surface of the extension portion and a side surface of the light emergent portion of the condenser are opposite and engaged with each other.

Optionally, the extension portions are in the number of two, and each of the two extension portions is opposite to a respective side of the light emergent portion of the condenser and is engaged with it.

Optionally, the optical module further comprises a low beam light source and a low beam mirror, light emitted by the low beam light source is reflected by the low beam mirror, and an upper area of the light emergent portion of the condenser is located in an optical path of the light reflected by the low beam mirror.

Optionally, a reinforcing rib is connected between the individual light guiding members.

Optionally, a top surface of the light emergent portion of the condenser comprises a first plane and a second plane, and when the condenser is horizontally placed, the horizontal level where the first plane is located is higher than the horizontal level where the second plane is located, with a slope formed between the first plane and the second plane.

Optionally, the optical module further comprises a lens, a lens bracket, a dimming bracket, a high beam circuit board, a low beam mirror, a low beam circuit board, a heat sink and a fan;

the lens is fixedly connected with the lens bracket, and the dimming bracket is connected to both of the lens bracket and the heat sink;

the low beam circuit board and the high beam circuit board are both mounted on the heat sink, the low beam circuit board is mounted at an upper portion of the heat sink and is provided corresponding to the low beam mirror, and the high beam circuit board is provided at a side of the heat sink facing the lens;

the light-condensing assembly is connected with the heat sink, and the light emergent portion of the condenser faces the lens; and the fan is located at a side of the heat sink facing away from the lens.

The beneficial effects of the optical module of the embodiments of the present disclosure over the prior art include, for example, the following:

The optical module is applied to the automobile lamp, and after the high beam lamp is turned on, light emitted by the high beam light source enters the light guiding member via a light incident end of the light guiding member, and is emitted from the light emergent portion of the light guiding member. Since light emergent ends of the light guiding members corresponding to the respective high beam light sources converge together, the condenser performs a function of converging the light emitted by the respective high beam light sources, and the light emitted by adjacent high beam light sources is made to merge somewhat in the light emergent portion of the light guiding member, so that light patterns of the emitted light are joined more evenly. Since there are a plurality of high beam light sources which are provided at intervals in one direction, and the light emitted by different high beam light sources has different illuminating areas, the illuminating areas of the automobile lamp may be controlled by controlling on and off of each of the high beam light source, so as to avoid the area where the vehicle travelling opposite is located, thereby avoiding the phenomenon that the driver of the vehicle travelling opposite is dazzled.

An object of the present disclosure is further to provide an automobile lamp to solve the technical problem existing in the prior art that the driver of the vehicle travelling opposite will be dazzled due to the intense light emitted by the high beam lamp.

Embodiments of the present disclosure may be implemented as follows:

An embodiment of the present disclosure provides an automobile lamp in which the above optical module is mounted.

The automobile lamp has the same advantages as those of the above-described optical module over the prior art, which are not described herein repeatedly.

BRIEF DESCRIPTION OF DRAWINGS

To illustrate the technical solution of the embodiments of the present disclosure more clearly, drawings required for use in the embodiments will be introduced briefly below. It should be understood that the following drawings show only some embodiments of the present disclosure and therefore it should not be considered as a limitation on the scope, and those ordinary skilled in the art may further obtain other related drawings in the light of the drawings without any inventive labor.

Figure 1:
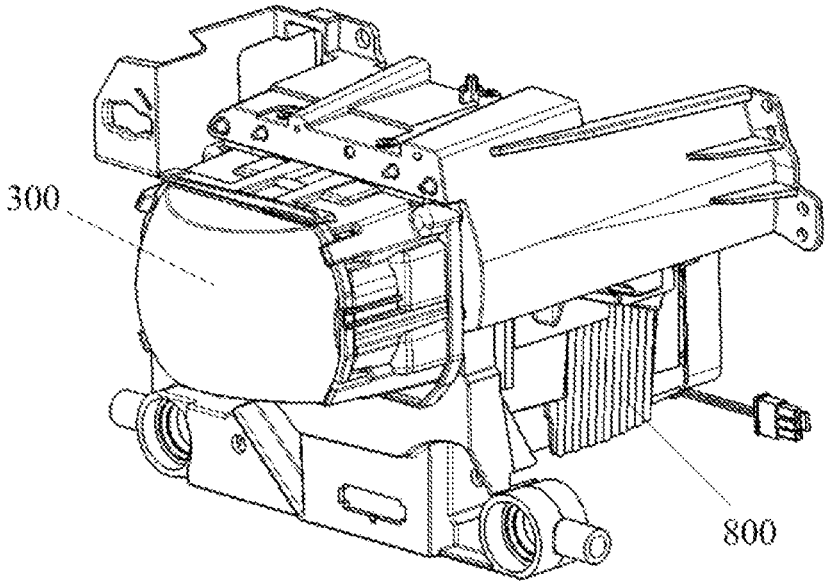
FIG. 1 is a first structural schematic view of an optical module provided by an embodiment of the present disclosure.

In the drawings: 100—light-condensing assembly; 110—condenser; 111—light guiding member; 112—light incident end; 113—light emergent portion; 114—light-condensing groove; 115—reinforcing rib; 116—mounting corner; 117—collar; 118—mounting bracket; 120—first connecting member; 121—position limiting groove; 122—position limiting post; 123—receiving groove; 124—positioning groove; 130—second connecting member; 131—position limiting hole; 132—pressing plate; 133—extension portion; 134—first plane; 135—second plane; 136—slope; 140—positioning pin; 200—high beam circuit board; 210—high beam light source; 220—plug member; 300—Lens; 400—lens bracket; 500—dimming bracket; 600—low beam mirror; 700—low beam circuit board; 710—low beam light source; 800—heat sink; 810—positioning post; 900—fan.

DETAILED DESCRIPTION OF THE EMBODIMENTS

In order to make the object, technical solution and advantages of the embodiments of the present disclosure clearer, the technical solutions of the embodiments in the present disclosure will be clearly and completely described in the following with reference to the figures in the present disclosure. It is apparent that the described embodiments are some but not all of the embodiments of the present disclosure. The assemblies of the present disclosure, which are generally described and illustrated in the figures herein, may be arranged and designed in a variety of different configurations.

Therefore, the detailed description of the embodiments of the present disclosure set forth in the figures is not intended to limit the claimed scope of the present disclosure, but illustrates only the selected embodiments of the present disclosure. All the other embodiments, obtained by those ordinary skilled in the art in light of the embodiments of the present disclosure without inventive efforts, will all fall within the claimed scope of the present disclosure.

It should be noted that similar reference numerals and letters indicate similar items in the following figures, and therefore, once an item is defined in a figure, it is not necessary to further define or explain it in the subsequent figures.

In the description of the present disclosure, it should be indicated that orientation or positional relations indicated by terms such as “center”, “up”, “down”, “left”, “right”, “vertical”, “horizontal”, “inside”, and “outside”, if present, are based on the orientation or positional relations shown in the figures, or orientation or positional relations in which the inventive product is placed conventionally in use, only for facilitating description of the present disclosure and simplifying the description, rather than indicating or implying that the referred devices or elements must be in a particular orientation or constructed or operated in the particular orientation, and therefore they should not be construed as position limiting the present disclosure.

In addition, terms such as "first", "second", and "third", if present, are used only for distinguishing the description, and should not be construed as indicating or implying relativity importance.

In addition, terms "horizontal", "vertical", "overhanging", etc., if present, does not mean that the component is required to be absolutely horizontal or overhanging, but may be slightly inclined. For example, the term "horizontal" merely means that the direction is more horizontal with respect to "vertical", and does not mean that the structure must be completely horizontal, but may be slightly inclined.

In the description of the present disclosure, it should be indicated that unless otherwise expressly specified or defined, terms such as "provide", "mount", "couple", and "connect", if present, should be understood broadly, and for example, it may be a fixed connection, or a detachable connection, or an integrated connection; may be a mechanical connection or an electric connection; and may be a direct connection, or an indirect connection via an intermediate medium, or may be an internal communication between two elements. The specific meanings of the above-mentioned terms in the present disclosure could be understood by those ordinary skilled in the art according to specific situations.

It should be noted that features in the embodiments of the present disclosure may be combined with one another without conflict.

As shown in FIGS. 1-8, the embodiment of the present disclosure provides an optical module, comprising: a light-condensing assembly 100 and a plurality of high beam light sources 210, wherein the plurality of high beam light sources 210 are provided at intervals in one direction, the light-condensing assembly 100 comprises a condenser 110, the condenser 110 comprises a plurality of light guiding members 111, a light incident end 112 of each of the light guiding members 111 is provided in one-to-one correspondence with each of the high beam light sources 210, light emergent ends of the respective light guiding members 111 converge together and form an arc-shaped light emergent portion 113, and an included angle between adjacent light guiding members 111 is an acute angle.

The optical module provided by an embodiment of the present disclosure is applied to the automobile lamp, and after the high beam lamp is turned on, light emitted by the high beam light source 210 enters the light guiding member 111 via a light incident end 112 of the light guiding member 111, and is emitted from a light emergent portion 113 of the light guiding member 111. Since light emergent ends of the light guiding members 111 corresponding to the respective high beam light sources 210 converge together, the condenser 110 performs a function of converging the light emitted by the respective high beam light sources 210, and the light emitted by adjacent high beam light sources 210 is made to merge somewhat in the light emergent portion 113 of the light guiding member 111, so that light patterns of the emitted light are joined more evenly.

Since there are a plurality of high beam light sources 210 which are provided at intervals in one direction, and the light emitted by different high beam light sources 210 has different illuminating areas, the illuminating areas of the automobile lamp may be controlled by controlling on and off of each of the high beam light sources 210, so as to avoid the area where the vehicle travelling opposite is located, thereby avoiding the phenomenon that the driver of the vehicle travelling opposite is dazzled. It is noted that the high beam light sources 210 may employ LED light sources.

Figure 6:
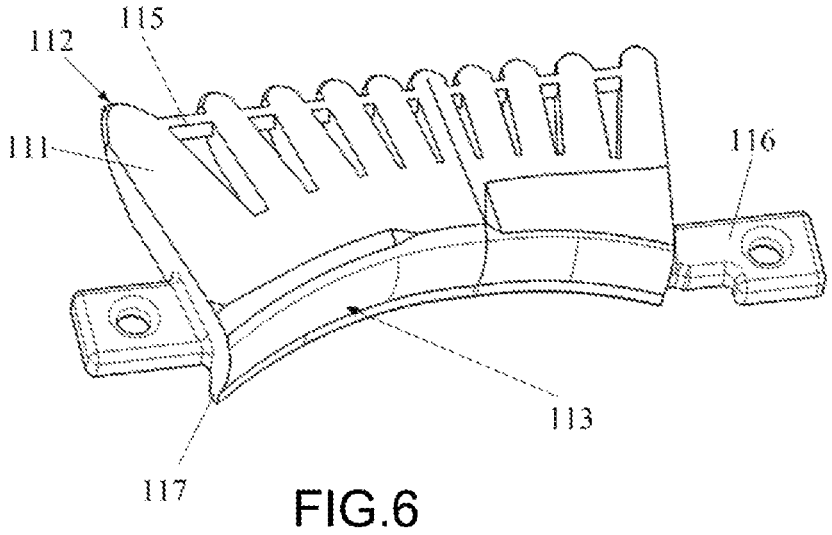
FIG. 6 is a structural schematic view of a condenser in an optical module provided by an embodiment of the present disclosure.

In conjunction with FIG. 6, light emergent ends of the light guiding members 111 converge together and form an arc-shaped light emergent portion 113, wherein the arc-shape is recessed in a direction close to the light incident end 112 of the light guiding member 111 to achieve a light-condensing effect after light is emitted. Moreover, optionally, a distance between a high beam light source 210 at left or right side and a corresponding light emergent portion 113 is greater than a distance between a high beam light source 210 at middle and a corresponding light emergent portion 113; and it can be understood that the farther the high beam light source 210 is from the middle, the greater the distance is, which is for reducing imaging aberration of the high beam light source 210 at the left and right sides with respect to the lens, wherein the mentioned "middle" herein refers to the high beam light source 210 at the most middle or at the center of the middle two.

Moreover, an included angle between adjacent light guiding members 111 is an acute angle, and it can be understood that, in FIG. 6, the light guiding member 111 is strip-shaped, and an included angle between a length direction of one of the light guiding members 111 and a length direction of another adjacent light guiding member 111 is an acute angle; or, it can be understood that an included angle between a propagating direction of the light in one of the light guiding members 111 and a propagating direction of the light in another adjacent light guiding member 111 is an acute angle. The acute angle ranges from 0° to 90°, optionally, for example, 5° to 45°.

Figure 7:
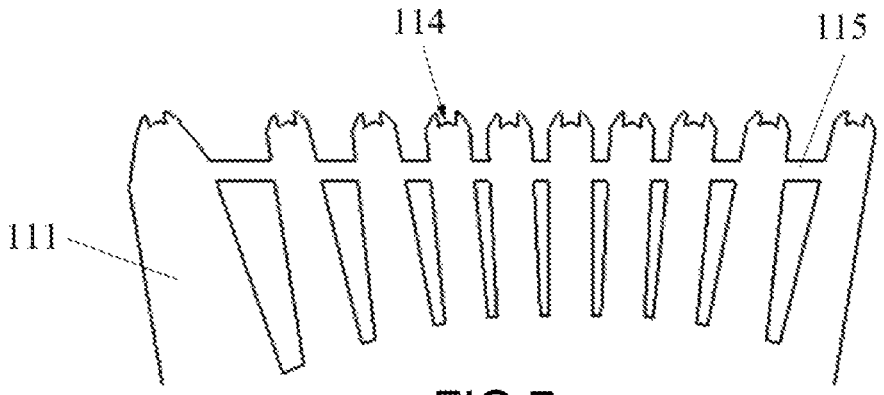
FIG. 7 is a partial schematic view of a condenser in an optical module provided by an embodiment of the present disclosure.

In conjunction with FIGS. 6 and 7, a plurality of light guiding members 111 are provided side by side, with a wedge gap provided between two adjacent light guiding members 111, wherein a small end of the wedge gap is relatively far away from the high beam light sources 210, and a big end of the wedge gap is relatively close to the high beam light sources 210, and when the light emitted by the high beam light sources 210 propagates in the light guiding members 111, light in each light guiding member 111 propagates in the corresponding light guiding member 111 independently, and the light that propagates originally in the respective light guiding member 111 merges and emits out of the light emergent portion 113 after the light propagates to the above small end of the wedge gap.

For example, when there are three high beam light sources 210, the three high beam light sources 210 are respectively configured to illuminate a left side area, a middle area, and a right side area, and when the vehicle travelling opposite comes from the left side, the high beam light sources 210 illuminating the left side area are turned off, and only the high beam light sources 210 illuminating the right side area and the middle area are turned on, thus ensuring that the driver of the present vehicle can obtain a wider view without a phenomenon that the driver of a vehicle travelling opposite is dazzled.

Figure 8:
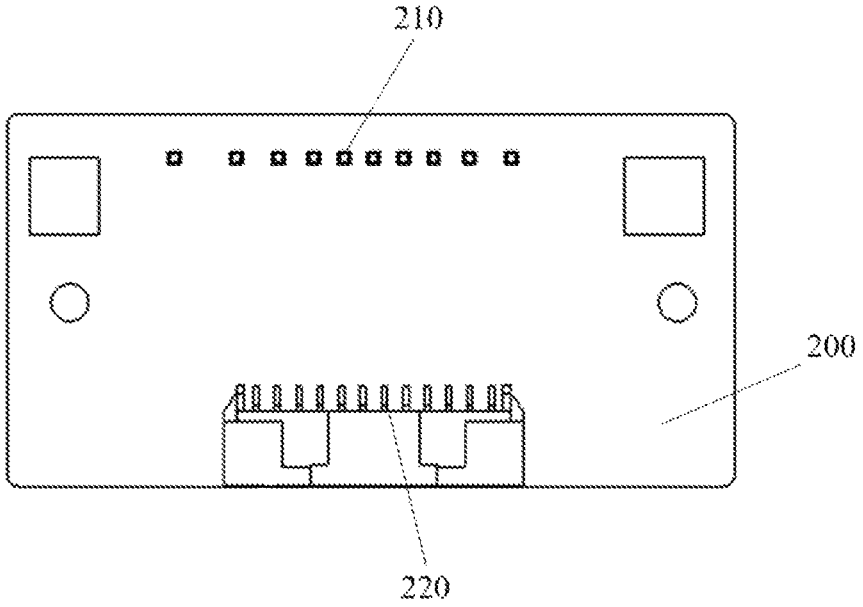
FIG. 8 is a structural schematic view of a high beam circuit board in an optical module provided by an embodiment of the present disclosure.

As shown in FIG. 8, the optical module further comprises a high beam circuit board 200, and the high beam light sources 210 are mounted on the high beam circuit board 200. In FIG. 8, there are ten high beam light sources 210, and the high beam light sources 210 are arranged at intervals along a length direction of the circuit board. By such arrangement, the illuminating area of the automobile lamp may be divided into ten areas and controlled separately, so that there are more control modes, which is beneficial to achieve, on the basis of ensuring that the driver of the vehicle travelling opposite is not illuminated, further enlarging of the illuminating areas and increase of multiple choices for illuminating brightness.

In the embodiment, there may be 3-26 high beam light sources 210, and the number can be selected as required in the process of an actual application. When there are a relative small number of high beam light sources 210, it is more energy-saving and easy to control. When there are a relative large number of high beam light sources 210, the illuminating areas are divided more detailed, allowing more control modes and greater brightness.

In the embodiment, the light guiding members 111 and the high beam light sources 210 may in an equal number, and are provided in one-to-one correspondence. As shown in FIGS. 6 and 7, the light guiding member 111 has a width increasing gradually from a side of the light incident end 112 of the light guiding member 111 to a side of the light emergent end of the light guiding member 111.

Moreover, it can be understood that the number of the light guiding members 111 and the number of the high beam light sources 210 may not be equal. For example, when the user needs a module having 12 illuminating areas, module A which has 12 light guiding members 111 and 12 high beam light sources 210 may be provided, implementing 12 illuminating areas; when the user needs 10 illuminating areas, in order to reduce costs in development and manufacturing, the above 12 light guiding members 111 are still used, with the number of the high beam light sources 210 changed to 10 (for example, the leftmost one and rightmost one are removed), forming a module B, in which case the light guiding member 111 has a number greater than the number of the high beam light sources 210.

Moreover, in conjunction with FIGS. 6 and 7, the mentioned "width" herein, as introduced with respect to a relative position in FIGS. 6 and 7, may be understood as a distance in left and right directions of the light guiding member 111, or it may be understood as a distance along a direction in which each of the light guiding members 111 is arranged.

In conjunction with FIG. 7, an end face of the light incident end 112 of the light guiding member 111 is arc-shaped, and the end face of the light incident end 112 is provided with a light-condensing groove 114, the light-condensing groove 114 resembles a cylindrical, recessed groove, and a side wall and a bottom of the light-condensing groove 114 have some curvature. The light-condensing groove 114 has a center point corresponding to a center point of the high beam light source 210, thereby increasing the utilization rate of the light emitted by the high beam light source 210. The light-condensing groove 114 is provided in such a way that the light emitted by the high beam light source 210 is collected more in the light guiding member 111, which effectively improves the light efficiency.

Generally, a distance between the center point of the light-condensing groove 114 and the center point of a light-emitting surface of the high beam light source 210 is ≤2 mm, and optionally, the two center points may be provided coincident.

Optionally, a reinforcing rib 115 is connected between the individual light guiding members 111. In a specific implementation, the reinforcing rib 115 is connected to the side of the light guiding member 111 close to the light incident end 112, and the reinforcing rib 115 is configured to improve the structural strength and the relative precision between each of the light guiding members 111, ensuring that the relative distance between each of the light guiding members 111 are unchanged. In the embodiment, the light guiding member 111 and the reinforcing rib 115 are of an integrated structure.

In the embodiment, the condenser 110 is made of a light-transmitting material, optionally a transparent silica gel material, having an advantage that the transparent silica gel is resistant to high temperature, which is not easy to yellowing after a long-term lighting, and is soft in material and may be mounted at a distance close to the light source, having a high lighting effect. The function may also be achieved by using polycarbonate (PC), PMMA (polymethyl methacrylate), glass or other transparent resin materials.

Optionally, the optical module further comprises a heat sink 800, and to facilitate heat dissipation of the high beam circuit board 200, the high beam circuit board 200 is mounted on the heat sink 800. To facilitate the fixation of the light-condensing assembly 100, the light-condensing assembly 100 further comprises a mounting bracket 118, and the condenser 110 is connected with the heat sink 800 through the mounting bracket 118.

To ensure the connection strength of the mounting bracket, the mounting bracket is made of metal material, and a surface thereof is subjected to a matte black process to avoid unnecessary reflection.

Figure 4:
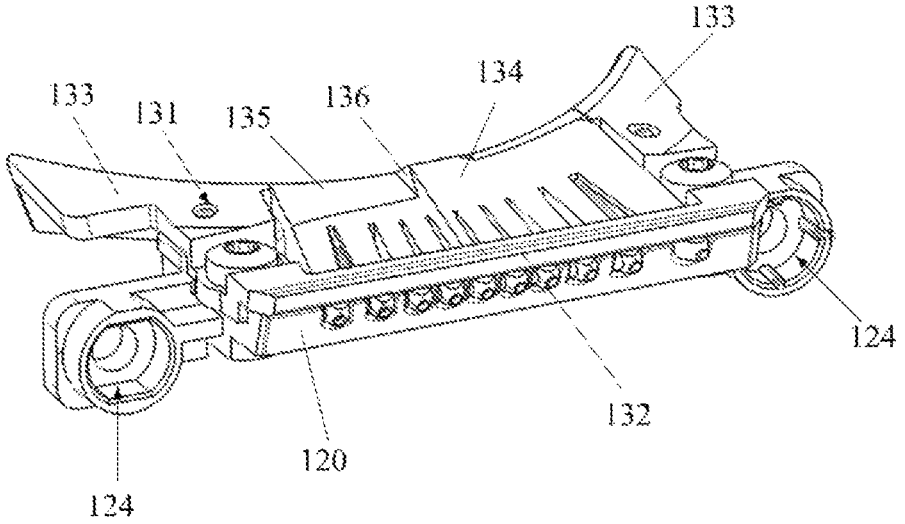
FIG. 4 is a schematic view of assembling of a light-condensing assembly in an optical module provided by an embodiment of the present disclosure.
Figure 5:
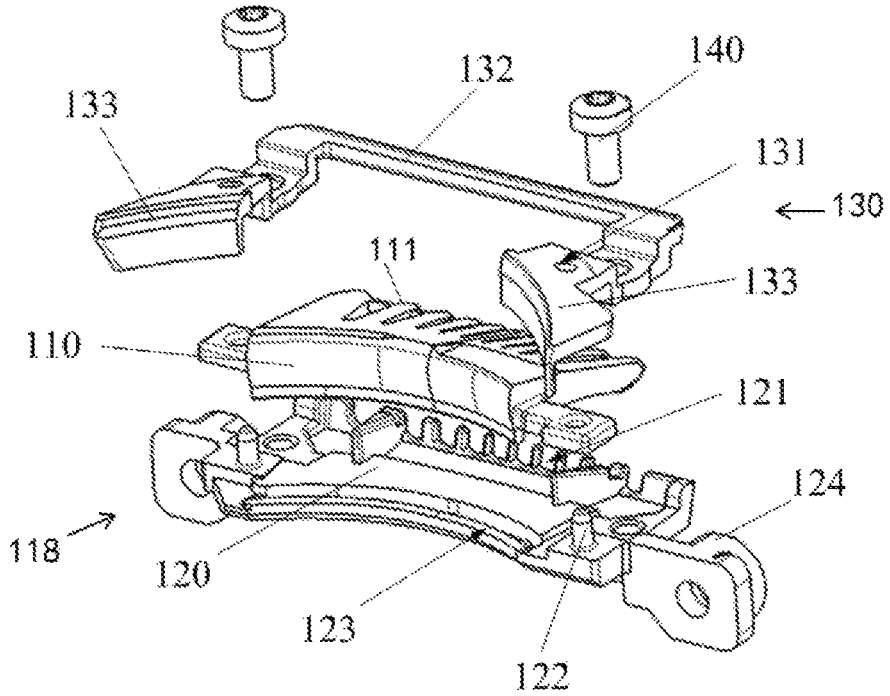
FIG. 5 is an exploded view of parts of a light-condensing assembly in an optical module provided by an embodiment of the present disclosure.

As shown in FIGS. 4 and 5, optionally, the mounting bracket 118 comprises a first connecting member 120 and a second connecting member 130 both connected with the condenser 110, the first connecting member 120 is provided thereon with a plurality of position limiting grooves 121, the light incident end 112 of the light guiding member 111 of the condenser 110 protrudes beyond the position limiting groove 121, and the first connecting member 120 and the second connecting member 130 are respectively located at the two opposite sides of the condenser 110.

To facilitate the connection of the condenser 110 with the mounting bracket 118, in conjunction with FIG. 6, either side of the condenser 110 is provided with a mounting corner 116, and the mounting corner 116 is provided thereon with a mounting hole, and a through hole is provided respectively on a position of the first connecting member 120 and the second connecting member 130 corresponding to the mounting hole. The mounting bracket 118 and the condenser 110 may be connected by a fastening member, for example, a bolt or a positioning pin, etc., and in FIG. 5 the connection of the mounting bracket 118 and the condenser 110 is implemented by using a positioning pin 140.

As introduced with respect to a relative position in FIG. 5, the first connecting member 120 is located below the condenser 110, the second connecting member 130 is located above the condenser 110, the second connecting member 130 and the first connecting member 120 sandwich the condenser 110 in upward and downward directions, and the positioning pin 140 passes through the through hole on the second connecting member 130, the mounting hole on the condenser 110, and the through hole on the first connecting member 120 from top to bottom, thereby connecting the mounting bracket 118 and the condenser 110.

Optionally, as shown in FIG. 4, to initially position the first connecting member 120 and the second connecting member 130 before the positioning pin 140 is mounted, a position limiting post 122 is provided on an upper surface of the first connecting member 120, and a position limiting hole 131 that cooperates with the position limiting post 122 is provided on the second connecting member 130.

In the mounting process, the position limiting post 122 is inserted into the position limiting hole 131 to perform an initial positioning. After the mounting is completed, the cooperation of the position limiting post 122 with the position limiting hole 131 also functions as limiting the position of the first connecting member 120 and the second connecting member 130.

To facilitate the initial positioning of the condenser 110 and the first connecting member 120, the light incident end 112 of the condenser 110 is placed into a corresponding position limiting groove 121, and the position limiting groove 121 functions as limiting the position of the condenser 110 on one hand, and separating the light incident ends 112 of respective light guiding members 111 to avoid mutual light crosstalk on the other hand. As shown in FIG. 5, the position limiting groove 121 is a U-shaped groove, with an upward opening, and the light incident end 112 of the condenser 110 is placed into the U-shaped groove from top to bottom.

Optionally, the bottom of the light emergent portion 113 of the condenser 110 is provided with a collar 117, and the top of the first connecting member 120 is provided with a receiving groove 123 for receiving the collar 117. When the condenser 110 is placed on the first connecting member 120, the collar 117 is protruded into the receiving groove 123, thereby performing a function of initially positioning.

In the embodiment, the mounting bracket 118 and the heat sink 800 are connected by a bolt. To facilitate initial positioning of the mounting bracket 118 and the heat sink 800 when they are connected, a positioning post 810 is provided on the heat sink 800, and a positioning groove 124 that cooperates with the positioning post 810 is provided on the mounting bracket 118.

Specifically, a positioning groove 124 is provided at either end of the first connecting member 120, and there is an interference fit between the positioning groove 124 and the positioning post 810. To make the connection between the positioning groove 124 and the positioning post 810 more tight, the side of the positioning groove 124 may be enclosed by two opposite arc surfaces and two opposite planes, or a positioning rib is provided in the positioning groove 124. The two positioning grooves 124 may have the same structure or different structures. For example, in FIG. 4, the positioning groove 124 on the left side is enclosed by two opposite arc surfaces and two opposite planes, and the positioning groove 124 on the right side is provided therein with four positioning ribs, wherein each of the positioning ribs is uniformly distributed in the positioning groove 124 along a circumferential direction of the positioning groove 124.

As shown in FIG. 8, a rectangular hole is provided on the high beam circuit board 200, and the positioning post 810 protrudes beyond the rectangular hole to cooperate with the positioning groove 124. Of course, the shape of the hole is not limited to a rectangle, and may be a shape such as a circle, a polygon, or the like.

The high beam light source board 200 is further provided thereon with a plug member 220, which is configured to be connected to a power source or a control device to control each of the high beam light sources 210.

Figure 3:
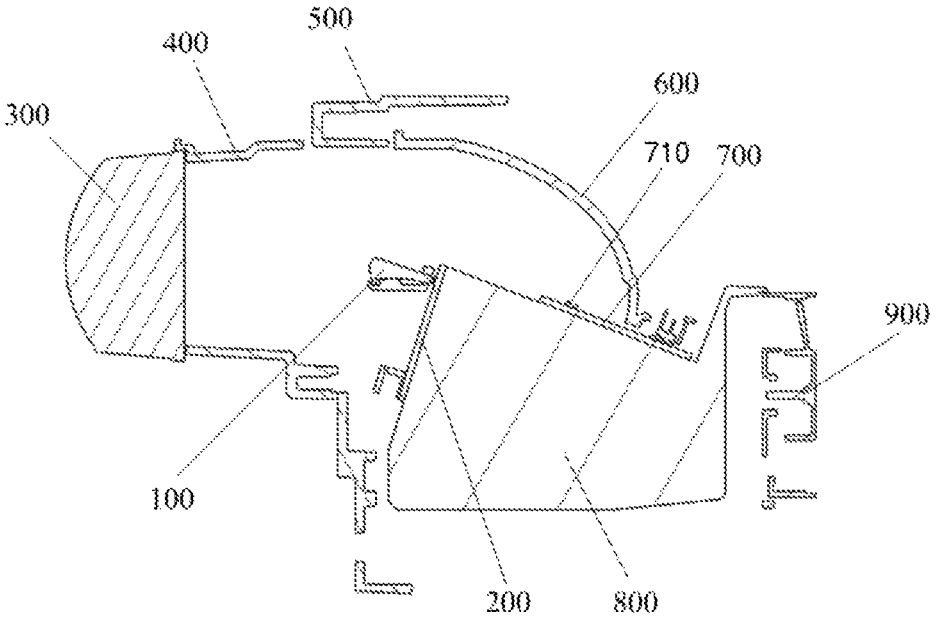
FIG. 3 is a cross-sectional view of an optical module provided by an embodiment of the present disclosure.

In the optical module provided in the embodiment, a low beam function may also be integrated. As shown in FIG. 3, the optical module further comprises a low beam light source 710 and a low beam mirror 600, and light emitted by the low beam light source 710 is emitted through the low beam mirror 600, and an upper area of the light emergent portion 113 of the condenser 110 is located in an optical path of the light reflected by the low beam mirror 600. By such arrangement, the upper area of the light emergent portion 113 of the condenser 110 may form a low beam cut-off line. With the cut-off effect of the integrated low beam, the structure of the automobile lamp module integrated with the low beam is simplified, and an edge line of an upper end of the light emergent portion 113 of the condenser 110 may be of a shape of a low beam cut-off line, so that the low beam light emitted by the upper area of the light emergent portion 113 may form a low beam light pattern having a low beam cut-off line.

Optionally, due to a relatively narrow angle range of the high beam in the horizontal direction and a relatively large width of the low beam, in order to form the cut-off line of the entire low beam, the second connecting member 130 comprises a pressing plate 132 and an extension portion 133 that are connected to each other, the pressing plate 132 is in contact with an area of the condenser 110 close to the light incident end 112, and a side surface of the extension portion 133 and a side surface of the light emergent portion 113 of the condenser 110 are opposite and engaged with each other.

The extension portion 133 is arc-shaped. After the extension portion 133 and the light emergent portion 113 of the condenser 110 are opposite and engaged with each other, the extension portion 133 and the light emergent portion 113 form an arc-shaped structure with a wider width, and the extension portion 133 cooperates with upper boundary of the light emergent portion 113 of the condenser 110, forming a complete low beam cut-off line.

There may be one or two extension portions 133. When there is one extension portion 133, the extension portion 133 and one of the sides of the light emergent portion 113 of the condenser 110 are opposite and engaged with each other; as shown in FIGS. 4 and 5, when there are two extension portions 133, each of the two extension portions 133 is opposite to a respective side of the light emergent portion 113 of the condenser 110 and is engaged with it.

Optionally, in conjunction with FIG. 4, a top surface of the light emergent portion 113 of the condenser 110 comprises a first plane 134 and a second plane 135, and when the condenser 110 is placed horizontally, the first plane 134 is at a horizontal level higher than a horizontal level at which the second plane 135 is located, with a slope 136 formed between the first plane 134 and the second plane 135.

A top surface of the extension portion 133 at a side of the first plane 134 is at the same level as the first plane 134, and a top surface of the extension portion 133, which is at a side of the second plane 135 and is opposite to and engaged with it, is at the same level as the second plane 135. An included angle between the slope 136 and the first plane 134 may be an angle of 15°, 30°, 45° or the like.

It can be understood that, with the first plane 134, the second plane 135 and the slope 136 provided, a cut-off line having a certain knee-point inclination can be formed at the upper end (top surface) of the light emergent portion 113; of course, it can be achieved even if the above three surfaces are not distinguished, for example, this purpose can be achieved when the top surface of the light emergent portion 113 is provided as an abnormal curved surface whose intersecting line with the light emergent portion 113 is of a cut-off line shape.

Figure 2:
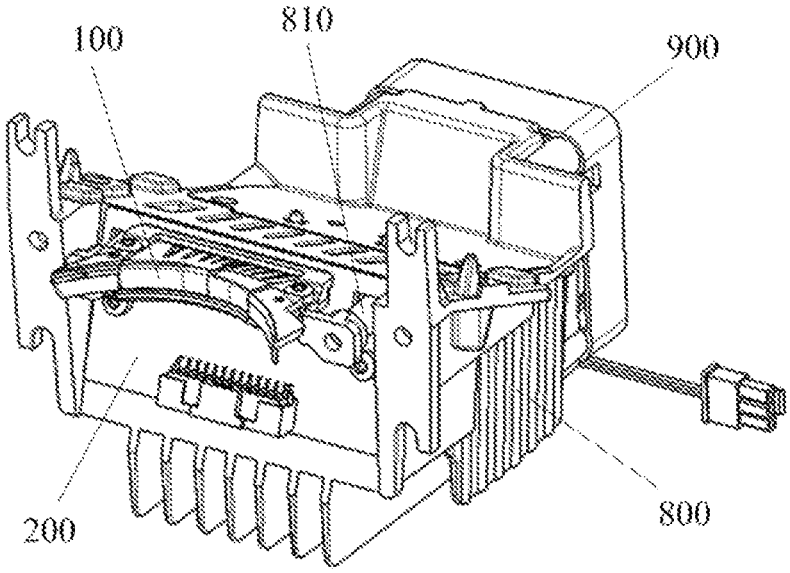
FIG. 2 is a second structural schematic view of an optical module provided by an embodiment of the present disclosure.

As shown in FIGS. 1-3, optionally, in a specific embodiment, the optical module comprises a lens 300, a lens bracket 400, a dimming bracket 500, a light-condensing assembly 100, a high beam circuit board 200, a low beam mirror 600, a low beam circuit board 700 and a heat sink 800. Wherein the lens 300 is fixed by the lens bracket 400, the dimming bracket 500 connects the lens 300 and the heat sink 800 and other structures, the low-beam circuit board 700 and the high beam circuit board 200 are both mounted on the heat sink 800, the low beam circuit board 700 is mounted at an upper portion of the heat sink 800 and provided corresponding to the low beam mirror 600, and the high beam circuit board 200 is provided at a side of the heat sink 800 facing the lens 300. The light-condensing assembly 100 is connected with the heat sink 800, the light incident end 112 of the condenser 110 in the light-condensing assembly 100 faces the high beam light source 210 on the high beam circuit board 200, and the light emergent portion 113 of the condenser 110 faces the lens 300. To speed up the heat dissipation efficiency of the heat sink 800, the optical module further comprises a fan 900, wherein the fan 900 is located at a side of the heat sink 800 facing away from the lens 300.

The heat sink 800 may be a metal aluminum die-pressed casting. The lens 300 is a convex lens, and the lens 300 has a focal plane in the vicinity of the low beam cut-off line collectively formed by the condenser 110 and the extension portion 133.

An embodiment of the present disclosure further provides an automobile lamp in which the above optical module is mounted.

The automobile lamp has the same advantages as those of the above-described optical module over the prior art, which are not described herein repeatedly.

In Some Embodiments

Referring to FIGS. 1 and 2, the optical module shown in FIGS. 1 and 2 comprises a light-condensing assembly 100, a high beam circuit board 200, a lens 300, a heat sink 800, and a fan 900, wherein the light-condensing assembly 100 is connected with the high beam circuit board 200, the high beam circuit board 200 is connected with the heat sink 800, the fan 900 is connected with the heat sink 800, the lens 300 and the heat sink 800 are respectively located at both sides of the heat sink 800, and the heat sink 800 is provided with a positioning post 810.

Referring to FIG. 3, the optical module shown in FIG. 3 comprises a light-condensing assembly 100, a high beam circuit board 200, a lens 300, a lens bracket 400, a dimming bracket 500, a low beam mirror 600, a low beam circuit board 700, a heat sink 800 and a fan 900, wherein the lens 300 is fixedly connected with the lens bracket 400, the dimming bracket 500 is connected to both of the lens bracket 400 and the heat sink 800, the low beam circuit board 700 and the high beam circuit board 200 are both mounted on the heat sink 800, the low beam circuit board 700 is mounted at an upper portion of the heat sink 800 and provided corresponding to the low beam mirror 600, the high beam circuit board 200 is provided at a side of the heat sink 800 facing the lens 300, the light-condensing assembly 100 is connected with the heat sink 800 and faces the lens 300, the fan 900 is connected with the heat sink 800 and located at a side of the heat sink 800 facing away from the lens 300, the low beam circuit board 700 is provided thereon with a low beam light source 710, and the low beam light source 710 is provided facing the low beam mirror 600.

Referring to FIGS. 4 and 5, the light-condensing assembly 100 in FIGS. 4 and 5 comprises a condenser 110, a mounting bracket 118 and a positioning pin 140, wherein the condenser 110 comprises a plurality of light guiding members 111, the mounting bracket 118 comprises a first connecting member 120 and the second connecting member 130, the first connecting member 120 is located below the condenser 110, the second connecting member 130 is located above the condenser 110, and the first connecting member 120 is provided thereon with a plurality of position limiting grooves 121 that adapt the light guiding members 111; the first connecting member 120 is provided with a through hole, the condenser 110 is provided with a mounting hole, and the second connecting member 130 is provided with a through hole, and after the positioning pin 140 passes through the through hole of the second connecting member 130, the mounting hole of the condenser 110, and the through hole of the first connecting member 120, a relative fixation among the first connecting member 120, the condenser 110 and the second connecting member 130 is implemented; the first connecting member 120 is provided with a position limiting post 122, the second connecting member 130 is provided with a position limiting hole 131, the position limiting hole 131 adapts the position limiting post 122, implementing a pre-positioning of the first connecting member 120 and the second connecting member 130; the second connecting member 130 comprises a pressing plate 132 and two extension portions 133, wherein the two extension portions 133 are respectively located at both ends of the pressing plate 132 and are both connected with the pressing plate 132, the pressing plate 132 is in contact with the condenser 110, and a side surface of the extension portion 133 and a side surface of the condenser 110 are opposite and engaged with each other; both ends of the first connecting member 120 are provided with a positioning groove 124, the positioning groove 124 cooperates with the positioning post 810 (shown in FIG. 1); a top surface of the condenser 110 comprises a first plane 134 and a second plane 135, with a slope 136 formed between the first plane 134 and the second plane 135; and the first connecting member 120 is provided with a receiving groove 123.

Referring to FIG. 6, the condenser 110 shown in FIG. 6 comprises a plurality of light guiding members 111, the plurality of light guiding members 111 are provided side by side, and all light emergent ends of the light guiding members 111 converge together to form an arc-shaped light emergent portion 113, and a reinforcing rib 115 is connected between light incident ends 112 of two adjacent light guiding members 111; both ends of the condenser 110 are provided with a mounting corner 116; and the condenser 110 is provided with a collar 117 that adapts the receiving groove 123 (shown in FIG. 5).

Referring to FIG. 7, the end face of the light incident end 112 of the light guiding member 111 shown in FIG. 7 is provided with a light-condensing groove 114.

Referring to FIG. 8, there are ten high beam light sources 210 shown in FIG. 8, wherein the ten high beam light sources 210 are distributed side by side at intervals, and not equidistant, the ten high beam light sources 210 are mounted on the high beam circuit board 200, and the high beam circuit board 200 is further provided thereon with a plug member 220.

What described above are only specific embodiments of the present disclosure, the protection scope of the present disclosure is not limited thereto, and changes or substitutions that would be easily conceived within the technical scope of the present disclosure by any technician familiar with the technique in the art should be covered within the scope of the disclosure. Therefore, the protection scope of the present disclosure should be determined by the protection scope of the claims.

INDUSTRIAL APPLICABILITY

To sum up, the present disclosure provides an optical module and an automobile lamp with a simple structure and in a reasonable design, which may effectively alleviate the technical defects existing in the prior art that the driver of the vehicle travelling opposite will be dazzled due to the intense light emitted by the high beam lamp.

The invention claimed is:

1. An optical module, comprising: a light-condensing assembly and a plurality of high beam light sources, wherein the plurality of high beam light sources are provided at intervals in one direction, the light-condensing assembly comprises a condenser, the condenser comprises a plurality of light guiding members, a light incident end of each of the light guiding members is provided in one-to-one correspondence with each of the high beam light sources, and light emergent ends of each of the light guiding members converge together and form an arc-shaped light emergent portion, and an included angle between adjacent light guiding members is an acute angle, wherein an end face of the light incident end of the light guiding member is arc-shaped, wherein the optical module further comprises a high beam circuit board, and the high beam light sources are mounted on the high beam circuit board, wherein the optical module further comprises a heat sink, the high beam circuit board is mounted on the heat sink, the light-condensing assembly further comprises a mounting bracket, and the condenser is connected with the heat sink through the mounting bracket, wherein the mounting bracket comprises a first connecting member and a second connecting member both connected with the condenser, the first connecting member is provided thereon with a plurality of position limiting grooves, the light incident end of the light guiding member of the condenser protrudes beyond the position limiting groove, and the first connecting member and the second connecting member are respectively located at the two opposite sides of the condenser, and wherein the second connecting member comprises a pressing plate and extension portion(s) that are connected to each other, the pressing plate is in contact with an area of the condenser close to the light incident end, and a side surface of the extension portion and a side surface of the light emergent portion of the condenser are opposite and engaged with each other.

2. The optical module according to claim 1, wherein the end face of the light incident end is provided with a light-condensing groove having a center point corresponding to a center point of the high beam light source.

3. The optical module according to claim 2, wherein the light guiding member has a width increasing gradually from a side of the light guiding member where the light incident end is located, to a side of the light guiding member where the light emergent end is located.

4. The optical module according to claim 1, wherein the light guiding member has a width increasing gradually from a side of the light guiding member where the light incident end is located, to a side of the light guiding member where the light emergent end is located.

5. The optical module according to claim 1, wherein the heat sink is provided with a positioning post, and the mounting bracket is provided with a positioning groove that cooperates with the positioning post.

6. The optical module according to claim 1, wherein the first connecting member is provided with a position limiting post, and the second connecting member is provided with a position limiting hole that cooperates with the position limiting post.

7. The optical module according to claim 1, wherein a bottom of the light emergent portion of the condenser is provided with a collar, and a top of the first connecting member is provided with a receiving groove for receiving the collar.

8. The optical module according to claim 1, wherein the extension portions are in the number of two, and each of the two extension portions is opposite to a respective side of the light emergent portion of the condenser and is engaged with it.

9. The optical module according to claim 1, wherein the optical module further comprises a low beam light source and a low beam mirror, light emitted by the low beam light source is reflected by the low beam mirror, and an upper area of the light emergent portion of the condenser is located in an optical path of the light reflected by the low beam mirror.

10. The optical module according to claim 1, wherein a reinforcing rib is connected between the individual light guiding members.

11. The optical module according to claim 1, wherein a top surface of the light emergent portion of the condenser comprises a first plane and a second plane, and when the condenser is horizontally placed, the horizontal level where the first plane is located is higher than a horizontal level where the second plane is located, with a slope formed between the first plane and the second plane.

12. The optical module according to claim 1, wherein the optical module further comprises a lens, a lens bracket, a dimming bracket, a high beam circuit board, a low beam mirror, a low beam circuit board, a heat sink and a fan;

the lens is fixedly connected with the lens bracket, and the dimming bracket is connected to both of the lens bracket and the heat sink;

the low beam circuit board and the high beam circuit board are both mounted on the heat sink, the low beam circuit board is mounted at an upper portion of the heat sink and is provided corresponding to the low beam mirror, and the high beam circuit board is provided at a side of the heat sink facing the lens;

the light-condensing assembly is connected with the heat sink, and the light emergent portion of the condenser faces the lens; and the fan is located at a side of the heat sink facing away from the lens.

13. An automobile lamp, wherein the optical module according to claim 1 is mounted in the automobile lamp.

* * * * *